United States Patent [19]

Tanabe

[11] 4,316,068

[45] Feb. 16, 1982

[54] COOKING UTENSIL CONTROLLED BY GAS SENSOR OUTPUT AND THERMISTOR OUTPUT

[75] Inventor: Takeshi Tanabe, Higashiosaka, Japan

[73] Assignee: Sharp Kabushiki Kaisha, Osaka, Japan

[21] Appl. No.: 113,073

[22] Filed: Jan. 17, 1980

[30] Foreign Application Priority Data

Jan. 25, 1979 [JP] Japan ..... 54-7729

[51] Int. Cl.[3] ..... H05B 6/68; H05B 1/02

[52] U.S. Cl. ..... 219/10.55 B; 219/10.55 R; 219/497; 340/634

[58] Field of Search ..... 219/10.55 B, 10.55 R, 219/502, 490, 497; 340/634, 632

[56] References Cited

U.S. PATENT DOCUMENTS

| | | | |
|---|---|---|---|
| 2,942,221 | 6/1960 | Girolamo | 200/5 R |
| 3,012,116 | 12/1961 | Boylan et al. | 200/5 R |
| 3,028,472 | 4/1962 | Baird | 219/10.55 B |
| 3,839,616 | 10/1974 | Risman | 219/10.55 R |
| 4,109,129 | 8/1978 | Satoh et al. | 219/10.55 B |
| 4,133,995 | 1/1979 | Buck | 219/10.55 B X |
| 4,162,381 | 7/1979 | Buck | 219/10.55 B |
| 4,181,744 | 1/1980 | Buck | 219/10.55 R |
| 4,188,520 | 2/1980 | Dills | 219/10.55 B |

FOREIGN PATENT DOCUMENTS

| | | | |
|---|---|---|---|
| 2744878 | 4/1978 | Fed. Rep. of Germany | 219/10.55 B |
| 2753405 | 6/1978 | Fed. Rep. of Germany | 219/10.55 B |
| 52-5033 | 1/1977 | Japan | 219/10.55 B |
| 52-5035 | 1/1977 | Japan | 219/10.55 B |
| 52-13150 | 2/1977 | Japan | 219/10.55 B |
| 52-47703 | 3/1977 | Japan | 210/10.55 B |
| 52-61850 | 5/1977 | Japan | 219/10.55 B |
| 54-2541 | 1/1979 | Japan | 219/10.55 B |
| 1500085 | 2/1978 | United Kingdom . | |
| 2002143 | 2/1979 | United Kingdom | 219/10.55 B |
| 2040502 | 8/1980 | United Kingdom | 219/10.55 B |

OTHER PUBLICATIONS

IBM TDB "Voltage Controlled Oscillator" by E. L. Newman, vol. 19, No. 10, pp. 3899-3900, Mar. 1977.

*Primary Examiner*—B. Dobeck
*Assistant Examiner*—Keith E. George
*Attorney, Agent, or Firm*—Birch, Stewart, Kolasch and Birch

[57] ABSTRACT

A combined microwave and electric heating oven comprises a gas sensor disposed in an exhaustion duct for detecting an exhaustion gas concentration, and a thermistor disposed in the exhaustion duct for detecting an exhaustion air temperature. A control circuit is connected to receive output signals derived from the gas sensor and the thermistor for terminating a cooking operation when both of the exhaustion gas concentration and the exhaustion air temperature exceed preseleted reference levels, respectively.

5 Claims, 14 Drawing Figures

COOKING UTENSIL CONTROLLED BY GAS SENSOR OUTPUT AND THERMISTOR OUTPUT

BACKGROUND AND SUMMARY OF THE INVENTION

The present invention relates to a cooking operation control system in a cooking utensil including at least two sensors, for example, a thermistor and a gas sensor.

Various kinds of sensors are proposed to control the cooking operation in a cooking utensil such as a combined microwave and electric heating cooking oven. For example, (1) a thermistor is disposed in an exhaustion duct for detecting an exhaustion air temperature;

(2) a humidity sensor is disposed in an oven cavity or in an exhaustion duct for detecting a humidity in the oven cavity; or (3) a gas sensor is disposed in an exhaustion duct for detecting an exhaustion gas concentration.

The thermistor and the humidity sensor can not detect the browning condition and, therefore, the thermistor and the humidity sensor are not suited for controlling the grill operation. The gas sensor is suited for controlling the grill operation, but the gas sensor will erroneously develop an output signal in an abnormal condition when, for example, alcohol is positioned near an air inlet of the cooking utensil. Moreover, the gas sensor output is dependent on the initial condition of the foodstuff being cooked and the amount of the foodstuff disposed in the oven cavity.

Accordingly, an object of the present invention is to provide a novel cooking operation control system in a cooking utensil.

Another object of the present invention is to provide a cooking operation control circuit for a combined microwave and electric heating cooking oven.

Still another object of the present invention is to provide a cooking operation control circuit in a combination microwave and electric heating cooking oven including a thermistor and a gas sensor.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a thermistor and a gas sensor are disposed in an exhaustion duct of a combined microwave and electric cooking oven for detecting a cooking condition. When both of the thermistor output and the gas sensor output exceed preselected reference levels, a microwave generation operation or a heater cooking operation is terminated to complete the cooking.

BRIEF DESCRIPTION OF THE DRAWINGS

The present invention will be better understood from the detailed description given hereinbelow and the accompanying drawings which are given by way of illustration only, and thus are not illustrative of the present invention and wherein.

DESCRIPTION OF THE PREFERRED EMBODIMENTS

A microwave oven controlled by a gas sensor output is disclosed in my copending application Ser. No. 71,179, "COOKING UTENSIL CONTROLLED BY GAS SENSOR OUTPUT" filed on Aug. 31, 1979.

Figure 1:
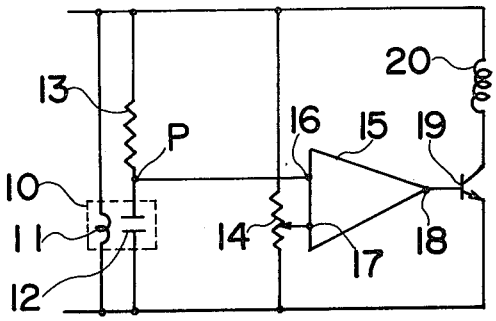
FIG. 1 is a circuit diagram of a basic detection system including a gas sensor.

FIG. 1 shows a basic construction of a gas concentration detection circuit.

A gas sensor 10 comprises a heater 11 and a sensor element 12. A resistor 13 is connected to the sensor element 12 in a series fashion, a node thereof being connected to a data input terminal 16 of a comparator 15. A reference voltage input terminal 17 of the comparator 15 is connected to receive a reference voltage from a variable resistor 14. When the gas concentration reaches a preselected value, a detection output is developed from an output terminal 18 of the comparator 15 to turn on a switching transistor 19. A relay 20 is connected to the switching transistor 19 to control the following circuit.

A preferred gas sensor suited for the microwave oven is "TGS#813" manufactured by Figaro Engineering Inc.

Figure 2:
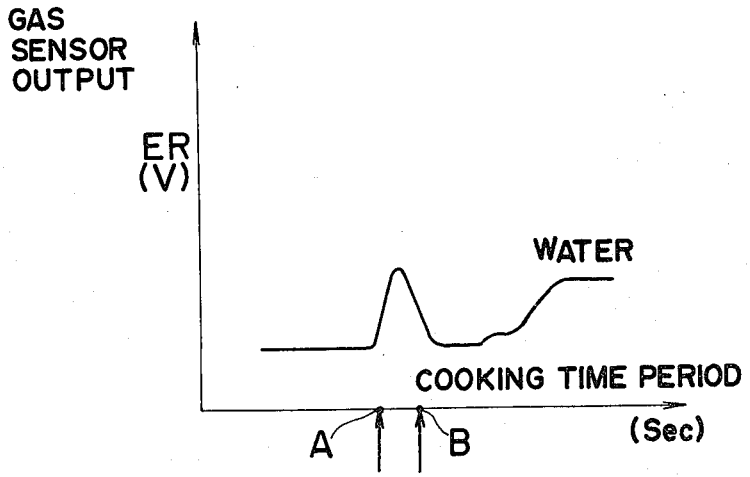
FIG. 2 is a graph showing an output of a gas sensor employed in a microwave oven.

When the above-mentioned gas concentration detection circuit is installed in a microwave oven, the cooking condition can be detected. However, the gas sensor output is dependent on the ambience condition. When, for example, alcohol is positioned near an air inlet of the microwave oven, the gas concentration detection circuit will erroneously operate. FIG. 2 shows an output signal of the gas sensor disposed in an exhaustion duct of the microwave oven, wherein alcohol is positioned near the air inlet at the point A, and the alcohol is spaced apart from the air inlet at the point B. It will be clear from FIG. 2 that the detection circuit may erroneously develop a detection signal even though the foodstuff (in FIG. 2, water) has not been completely cooked.

Moreover, the gas sensor output is dependent on the initial condition of the foodstuff and the amount of foodstuff disposed in the microwave oven. This is not preferable to ensure an accurate operation.

FIGS. 3 through 8 show output characteristics of the gas sensor disposed in the exhaustion duct of the microwave oven.

Figure 3:
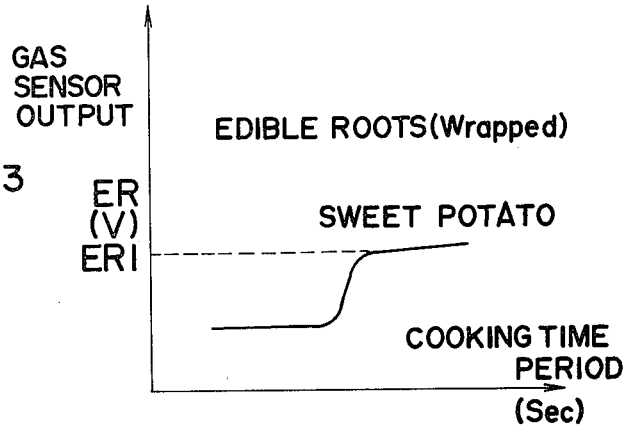
FIGS. 3 through 8 are graphs showing output characteristics of a gas sensor employed in a microwave oven.
Figure 4:
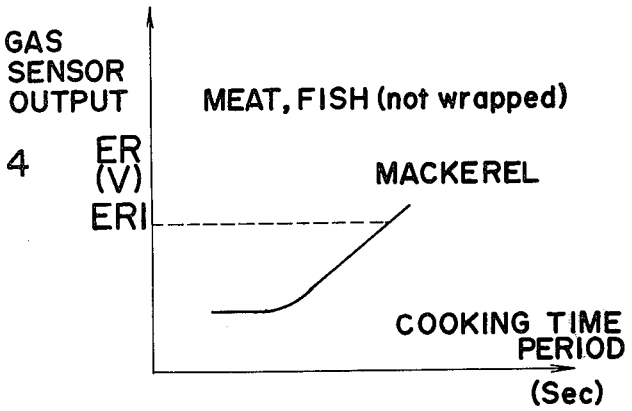
Figure 5:
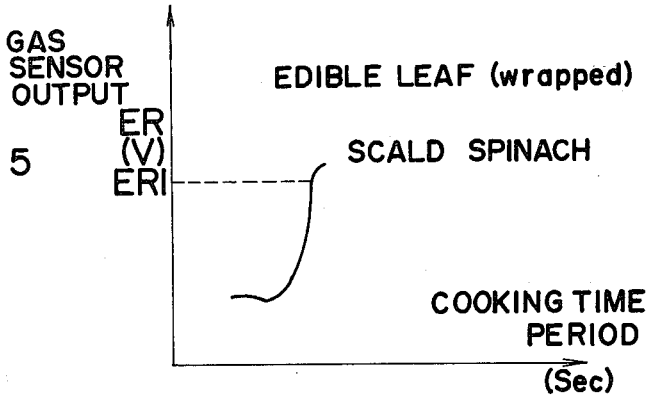
Figure 6:
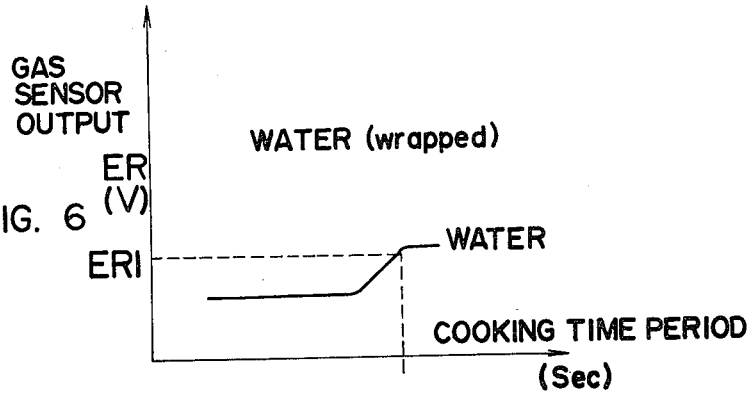

It will be clear from FIGS. 3 through 8, with respect to certain kinds of foodstuff, for example, sweet potato (FIG. 3) and water (FIG. 6), that the gas sensor output is saturated at a preselected value. Contrarily, the gas sensor output is not saturated when, for example, mackerel (FIG. 4) or spinach (FIG. 5) is cooked in the microwave oven. In addition, the gas sensor output is greatly influenced by the amount of foodstuff in the case where the foodstuff showing the characteristics of FIG. 3 or FIG. 6 is disposed in the microwave oven.

Figure 7:
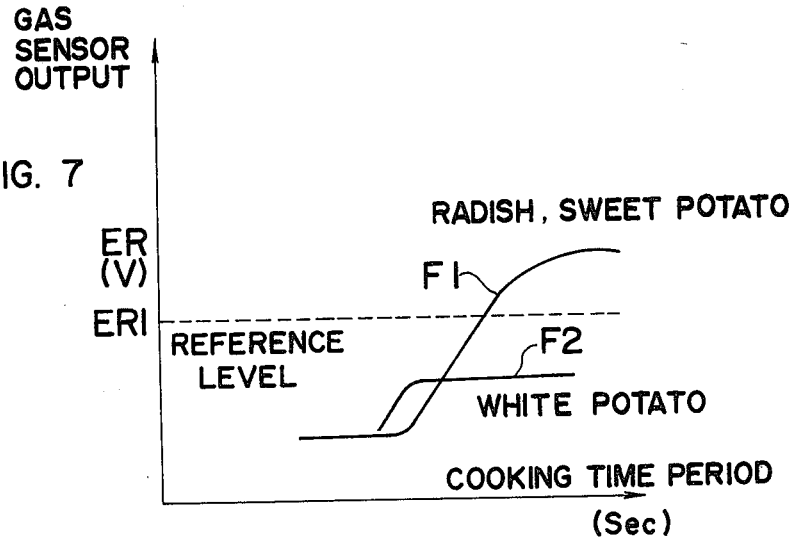
Figure 8:
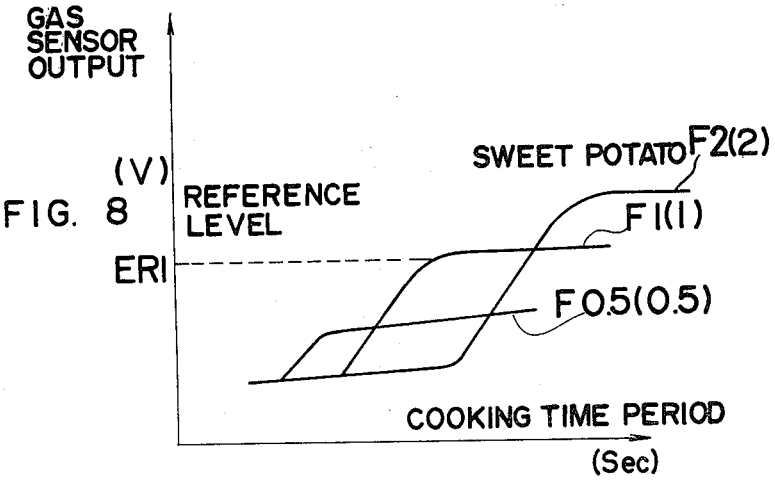

Accordingly, it is very difficult to determine a reference voltage level at which the detection circuit must operate. FIG. 7 shows that the saturation value of the gas sensor output is dependent on the kind of foodstuff. FIG. 8 shows that the saturation value of the gas sensor output is dependent on the number of sweet potatos disposed in the microwave oven, wherein a curve $F_2$ shows an output signal of the gas sensor when two sweet potatos are disposed in the microwave oven, a curve $F_1$ shows a gas sensor output when one sweet potato is disposed, and a curve $F_{0.5}$ shows a gas sensor output when a half of a sweet potato is disposed therein.

Therefore, it is desirable to combine output signals of the gas sensor and a thermistor to ensure an accurate cooking control.

Figure 9:
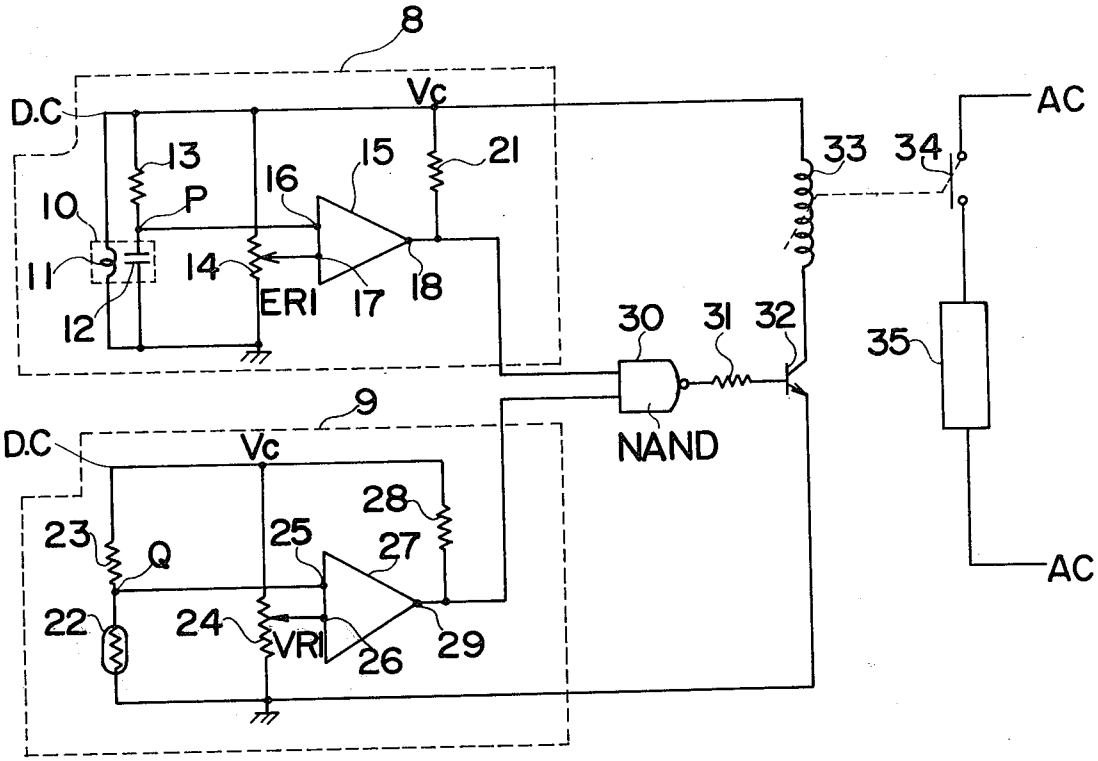
FIG. 9 is a circuit diagram of an embodiment of a cooking operation control system of the present invention.

FIG. 9 shows an embodiment of a cooking operation control system of the present invention. Like elements corresponding to those of FIG. 1 are indicated by like numerals.

The cooking operation control system mainly comprises a gas concentration detection circuit 8 and an exhaustion air temperature detection circuit 9.

The gas concentration detection circuit 8 comprises the gas sensor 10 including the heater 11 connected to a D.C. power source and the sensor element 12 connected to the D.C. power source through the resistor 13. The node P of the sensor element 12 and the resistor 13 is connected to the data input terminal 16 of a first comparator 15, and the reference voltage input terminal 17 of the first comparator 15 is connected to the variable resistor 14, which is connected to the D.C. power source, for receiving a reference voltage $ER_1$. The output terminal 18 of the first comparator 15 is connected to the D.C. power source via a resistor 21, and to one input terminal of a NAND gate 30.

The exhaustion air temperature detection circuit 9 comprises a thermistor 22, which is connected to the D.C. power source via a resistor 23. The node Q of the thermistor 22 and the resistor 23 is connected to a data input terminal 25 of a second comparator 27. A variable resistor 24 is also connected to the D.C. power source, of which the slidable terminal is connected to a reference voltage input terminal 26 of the second comparator 27 for applying a reference voltage $VR_1$ thereto. An output terminal 29 of the second comparator 27 is connected to the D.C. power source via a resistor 28, and to the other input terminal of the NAND gate 30.

An output terminal of the NAND gate 30 is connected to a base electrode of a switching transistor 32 via a resistor 31. The collector electrode of the switching transistor 32 is connected to the D.C. power source through a relay 33, and the emitter electrode thereof is grounded. A relay switch 34 is associated with the relay 33 for controlling the power supply to a microwave generation circuit 35.

The microwave generation circuit 35 can be substituted by a heater driver in case of an electric heating oven. Moverover, the microwave generation circuit and the heater driver must be controlled by the relay switch 34 in case of the combined microwave and electric heating oven.

The above-mentioned gas sensor 10 and the thermistor 22 are disposed in an exhaustion duct of the cooking utensil such as a microwave oven. When the gas concentration detected by the gas sensor 10 reaches a preselected value determined by the variable resistor 14, the first comparator 15 develops a detection output of the logic high. When the exhaustion air temperature detected by the thermistor 22 reaches a preselected value determined by the variable resistor 24, the second comparator 27 develops a detection output of the logic high.

When both of the first and second comparators 15 and 27 develop the detection outputs of the logic high, the NAND gate 30 terminates the development of a control signal of the logic high to turn off the switching transistor 32. Upon turning off of the switching transistor 32 the relay switch 34 is opened, whereby the power supply to the microwave generation circuit 35 is terminated. That is, the cooking operation is conducted till both of the gas concentration and the exhaustion air temperature exceed preselected values, respectively.

Figure 10:
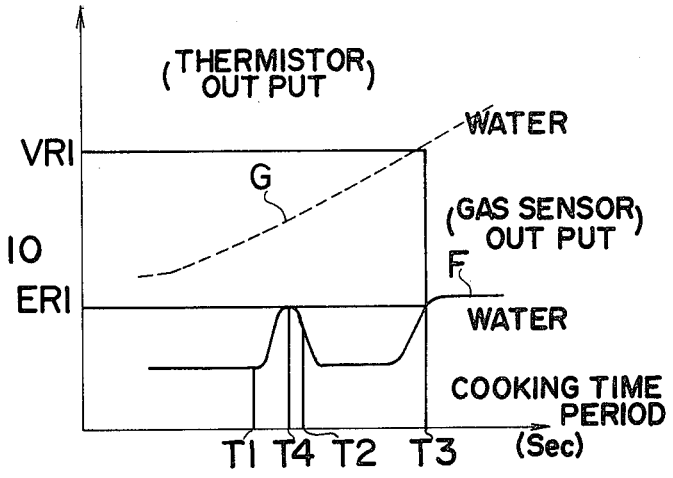
FIGS. 10 through 14 are graphs for explaining operation modes of the cooking operation control system of FIG. 9.

Since the cooking operation control system of the present invention responds to both of the gas sensor output and the thermistor output, the operation is quite stable. FIG. 10 shows the gas sensor output (F) and the thermistor output (G) when water is warmed in the microwave oven. When alcohol is positioned near the air inlet of the microwave oven at the time $T_1$, the gas sensor output (F) exceeds the reference level $ER_1$ at the time $T_4$. However, the microwave generation is not terminated, because the thermistor output (G) is below the reference level $VR_1$ at the time $T_4$. The alcohol is spaced apart from the air inlet at the time $T_2$. At the time $T_3$, both of the gas sensor output (F) and the thermistor output (G) exceed the reference levels $ER_1$ and $VR_1$, respectively, and therefore, the microwave generation is terminated.

Figure 11:
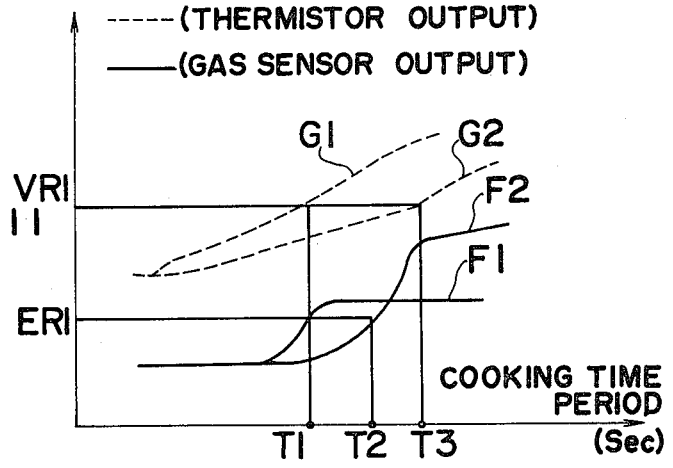

FIG. 11 shows the gas sensor output $F_1$ and the thermistor output $G_1$ when one sweet potato is cooked in the microwave oven, and the gas sensor output $F_2$ and the thermistor output $G_2$ when two sweet potatos are cooked in the microwave oven.

The cooking operation is terminated at the time $T_1$, at which the gas sensor output $F_1$ reaches the reference level $ER_1$, when one sweet potato is cooked, even though the thermistor output $G_1$ exceeds the reference level $VR_1$ in advance. The cooking operation is terminated at the time $T_3$, at which the thermistor output $G_2$ reaches the reference level $VR_1$, when two sweet potatos are cooked, even though the gas sensor output $F_2$ reaches the reference level $ER_1$ at the time $T_2$ earlier than the time $T_3$.

Figure 12:
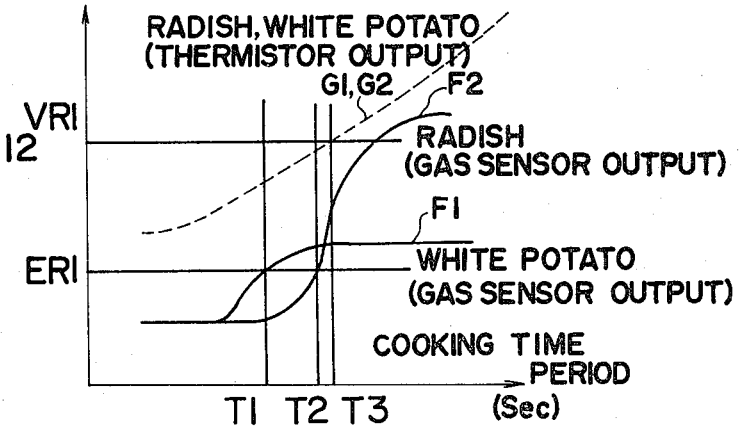

FIG. 12 shows the gas sensor output $F_1$ and the thermistor output $G_1$ when white potato is cooked in the microwave oven, and the gas sensor output $F_2$ and the thermistor output $G_2$ when radish is cooked in the microwave oven.

Although the gas sensor output $F_1$ reaches the reference level $ER_1$ at the time $T_1$, the cooking operation is continued until the time $T_3$ at which the thermistor output $G_1$ reaches the reference level $VR_1$. In case of the radish, even though the gas sensor output $F_2$ reaches the reference level $ER_1$ at the time $T_2$, the cooking operation is continued until the time $T_3$.

Figure 13:
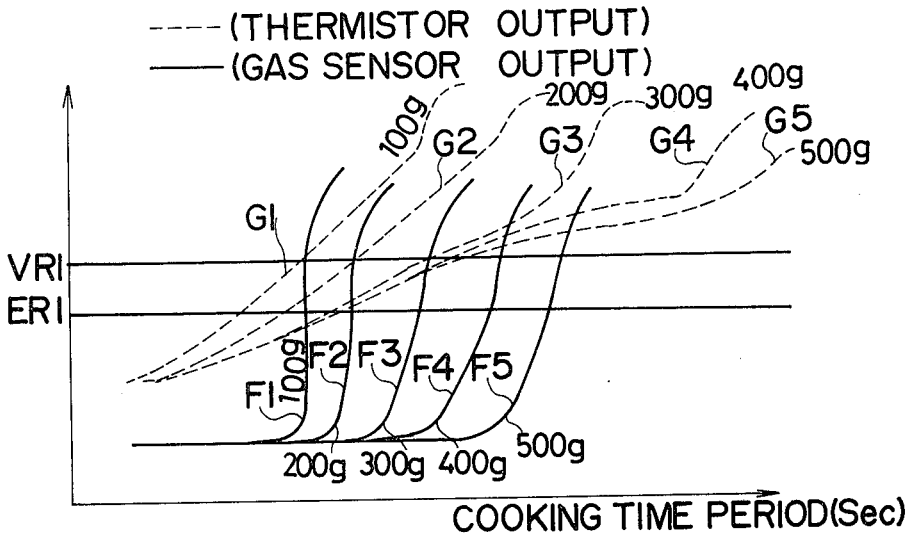

FIG. 13 shows the gas sensor output variation ($F_1$ through $F_5$) and the thermistor output variation ($G_1$ through $G_5$) depending on the amount of foodstuff.

It will be clear from FIG. 13 that the thermistor output takes a substantially same curve when the amount of foodstuff is above 300 grams. Accordingly, the cooking operation is properly controlled in response to the gas sensor output when the amount of foodstuff is above 300 grams.

Figure 14:
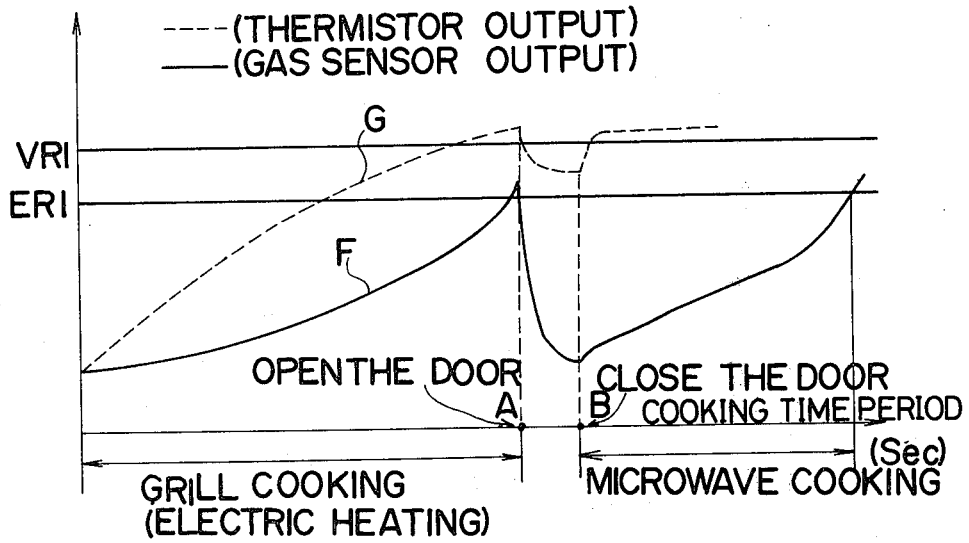

FIG. 14 shows the gas sensor output F and the thermistor output G in a combined microwave and electric heating oven, wherein the electric heating is first performed and the microwave cooking is last performed.

First, the electric heating cooking is performed. Upon completion of the electric heating cooking, the oven door is opened at a point A. Under these conditions, the gas sensor output F is suddenly reduced by opening the oven door at the point A, but the thermistor output G does not immediately fall due to the heat retained in the oven cavity. Thus, when the microwave cooking is initiated at a point B, the thermistor output G exceeds the reference level $VR_1$ in a short time. However, in accordance with the present invention, the gas sensor output F is also monitored to continue the microwave generation till the gas sensor output F reaches the reference level $ER_1$.

The above-mentioned variable resistors 14 and 24 are preferably interlocked so that the reference levels $ER_1$ and $VR_1$ are set when a desired menu is selected through a menu selection lever.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A cooking utensil comprising:

heat generating source means for cooking a foodstuff disposed in the cooking utensil;

gas sensor means for detecting the concentration of a gas emitted from the foodstuff being cooked in the cooking utensil and developing a first detection signal when the concentration of said gas exceeds a first reference level;

temperature sensor means for detecting the temperature of the foodstuff being cooked in the cooking utensil and developing a second detection signal when the temperature of the foodstuff exceeds a second reference level; and a control circuit for controlling the operation of said heat generating source means, said control circuit comprising:

determination means responsive to the first and second detection signals for developing a control signal when both said gas sensor means and said temperature sensor means develop said first and second detection signals, respectively; and driver means responsive to said control signal for terminating the operation of said heat generating source means in response thereto.

2. The cooking utensil of claim 1, wherein air is exhausted from an oven cavity of said cooking utensil during the cooking of said foodstuff, and wherein said temperature sensor means comprises a thermistor for detecting the temperature of the air exhausted from the oven cavity of said cooking utensil.

3. A microwave oven for cooking a foodstuff disposed therein, comprising:

microwave generation source means for generating microwave energy to cook said foodstuff;

gas sensor means for detecting the concentration of an exhaustion gas developed from said foodstuff during the cooking thereof in the microwave oven and developing a first detection signal when the concentration of said exhaustion gas exceeds a first selected value;

thermistor means for detecting the temperature of an exhaustion air exhausted from an oven cavity of said microwave oven and developing a second detection signal when the temperature of said exhaustion air exceeds a second selected value; and a control circuit for controlling the operation of said microwave generation source means, said control circuit comprising;

determination means responsive to the first and second detection signals for developing a control signal when both said gas sensor means and said thermistor means develop said first and second detection signals, respectively; and switching means responsive to said control signal for terminating the generation of said microwave energy from said microwave generation source means in response thereto.

4. The microwave oven of claim 3, wherein said determination means comprises:

first comparator means for receiving said first detection signal from said gas sensor means and a first reference level voltage signal and for developing a first determination signal when the first detection signal exceeds said first reference level voltage signal;

second comparator means for receiving said second detection signal from said thermistor means and a second reference level voltage signal and for developing a second determination signal when the second detection signal exceeds said second reference level voltage signal; and gate means responsive to the first and second determination signals for developing said control signal when both said first and said second determination signals are received from said first and second comparators, respectively.

5. A microwave oven in accordance with claim 3, wherein said exhaustion gas comprises reducing gases, said gas sensor means detecting the concentration of said reducing gases developed from said foodstuff.

* * * * *